US007018124B1

(12) United States Patent
Kageyama et al.

(10) Patent No.: US 7,018,124 B1
(45) Date of Patent: Mar. 28, 2006

(54) WRITING IMPLEMENT WITH STYLUS

(75) Inventors: Hidehei Kageyama, Kawagoe (JP); Yoshio Noguchi, Kawagoe (JP); Juri Saitou, Kawagoe (JP)

(73) Assignee: Kotobuki & Co., Ltd., Kawagoe (JP)

( * ) Notice: Subject to any disclaimer, the term of this patent is extended or adjusted under 35 U.S.C. 154(b) by 0 days.

(21) Appl. No.: 10/968,009

(22) Filed: Oct. 20, 2004

(51) Int. Cl.
*B43K 1/10* (2006.01)
*B43K 27/00* (2006.01)
*A74L 13/26* (2006.01)

(52) U.S. Cl. ..... 401/258; 401/32; 401/33; 401/37

(58) Field of Classification Search ..... 401/258, 401/259, 260, 195, 52, 32, 33, 37
See application file for complete search history.

(56) References Cited

U.S. PATENT DOCUMENTS 5,306,085 A * 4/1994 Kobayashi ..... 401/29
6,893,179 B1 * 5/2005 Kageyama et al. ..... 401/32

* cited by examiner

*Primary Examiner*—David J. Walczak
(74) *Attorney, Agent, or Firm*—Rothwell, Figg, Ernst & Manbeck

(57) ABSTRACT

A writing implement has a barrel provided with a separate front cap or a front cap formed integrally with the barrel, a writing member placed in the barrel, pushed constantly backward by a return spring and capable of axially sliding in the barrel, and a stylus mechanism. The stylus mechanism includes: a rotating cam engaged with a back end part of the writing member, a back cap provided on its inner surface with a fixed cam and fixedly attached to a back part of the barrel, a hollow plunger placed between the back cap and the rotating cam and having an externally threaded back part provided with an external thread, a stylus having an internally threaded bore provided with an internal thread in engagement with the external thread of the externally threaded part of the plunger, and provided on its outer surface with protrusions, and a hollow push button placed axially slidably in the back cap, and provided with guide ribs for guiding the protrusions of the stylus in its inner surface, and an opening through which the stylus is projected in its back end.

1 Claim, 12 Drawing Sheets

WRITING IMPLEMENT WITH STYLUS

BACKGROUND OF THE INVENTION

1. Field of the Invention

The present invention relates to a writing implement with a stylus, such as a ballpoint pen provided in its back end part with a stylus that is projected by a rotary device or a mechanical pencil provided in its back end part with a stylus that is projected by a rotary device.

2. Description of the Related Art

Some conventional writing implement is provided with an unretractable stylus having an exposed tip and some other conventional writing implement is provided with an unretractable stylus having a tip covered with a cap. It is possible that the tip of the stylus of the former writing implement accidentally scratches or pricks something. The latter writing implement requires a trouble to remove the cap to use the stylus and it is possible that the cap is lost. A writing implement proposed in JP-A 2002-62976 is provided with a writing member and a stylus and enables setting either of the writing member and the stylus at its working position for the selective use of the writing member or the stylus. However, both the writing member and the stylus cannot be set at their working positions simultaneously.

The stylus having a sharp tip needs to be covered while the stylus is not used. However, considerable effect is required to remove the cap because the cap is held on a barrel by a holding structure and considerable force is necessary to release the cap from the barrel. There has not been any writing implement provided with a writing member and a stylus that can be individually projected from and retracted into the barrel of the writing implement.

SUMMARY OF THE INVENTION

The present invention has been made in view of the foregoing problems and it is therefore an object of the present invention to provide a writing implement provided with both a writing member and a stylus held in a barrel and capable of being simultaneously or selectively projected from the barrel for use.

A writing implement according to the present invention includes: a barrel provided with a separate front cap or a front cap formed integrally with the barrel; a writing member placed in the barrel, pushed constantly backward by a return spring and capable of axially sliding in the barrel when a push button is operated; and a stylus mechanism including a stylus that can be projected by turning the push button.

The writing implement of the present invention is simple in construction, the writing member, such as a lead, can be projected and retracted by operating the push button, and the stylus can be surely projected and retracted by turning the push button. Thus, both the writing member and the stylus can be simultaneously kept projected, and either of the writing member and the stylus can be selectively used without requiring any additional operations.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
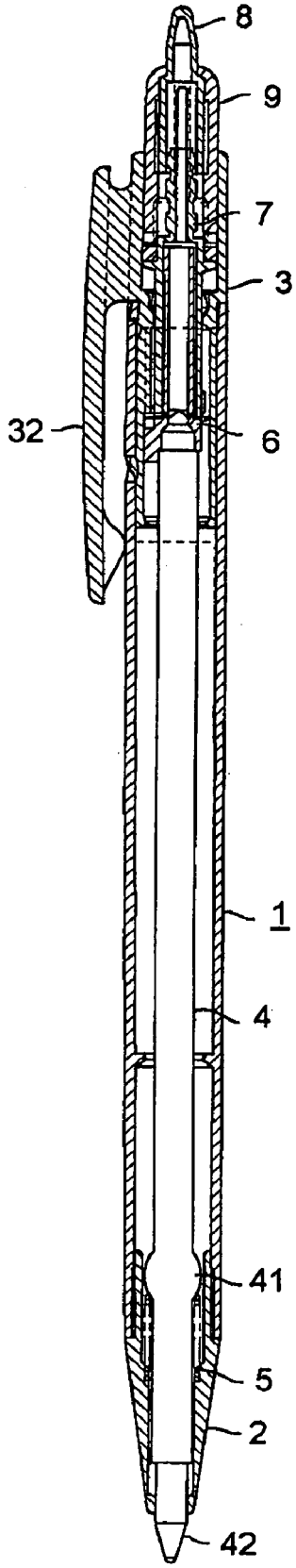
FIG. 1 is a longitudinal sectional view of a ballpoint pen provided with a stylus, namely, a writing implement with a stylus, in a preferred embodiment according to the present invention, in which both the writing tip of an ink cartridge and the stylus are projected for use.
Figure 2:
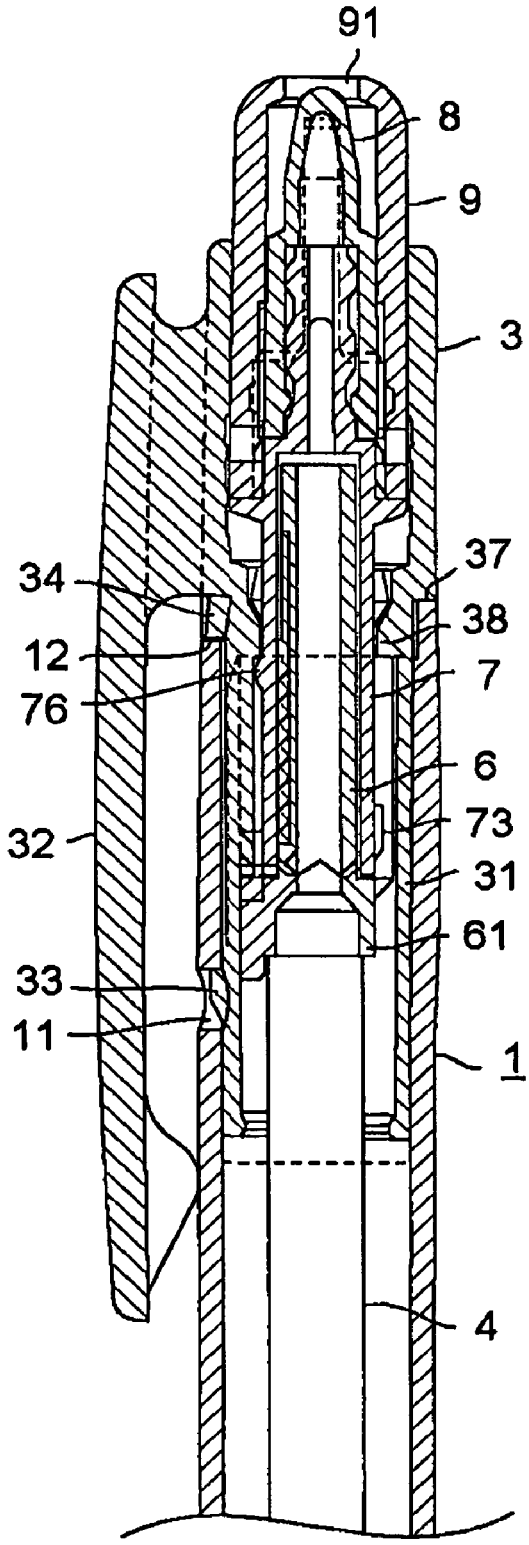
FIG. 2 is an enlarged longitudinal sectional view of an essential part of the ballpoint pen shown in FIG. 1, in which the tip of the ink cartridge is projected for use and the stylus is retracted.
Figure 3:
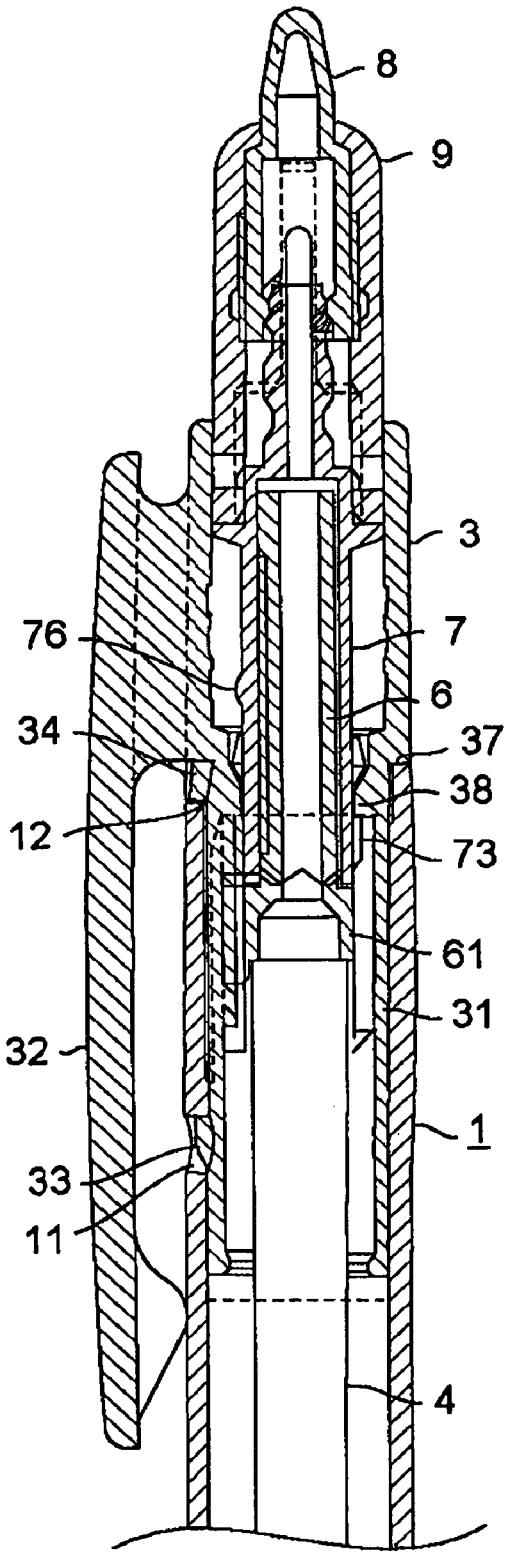
FIG. 3 is an enlarged longitudinal sectional view of an essential part of the ballpoint pen shown in FIG. 1, in which the tip of the ink cartridge is retracted and the stylus is projected for use.

FIG. 1 shows a ballpoint pen in a preferred embodiment according to the present invention provided with a ballpoint refill 4 and a stylus 8 in a state where both the ballpoint refill 4 and the stylus 8 are projected for use. FIG. 2 shows the ballpoint pen in a state where the stylus 8 is retracted and the ballpoint refill 4 is projected for use. FIG. 3 shows the ballpoint pen in a state where the stylus 8 is projected for use and the ballpoint refill 4 is retracted. Referring to FIGS. 1 to 3, a front cap 2 is detachably attached to the front end of a barrel 1. The front tip 2 may be formed integrally with the barrel 1. A back cap 3 is fixedly put on a back end part of the barrel 1 by pressure.

Figure 4:
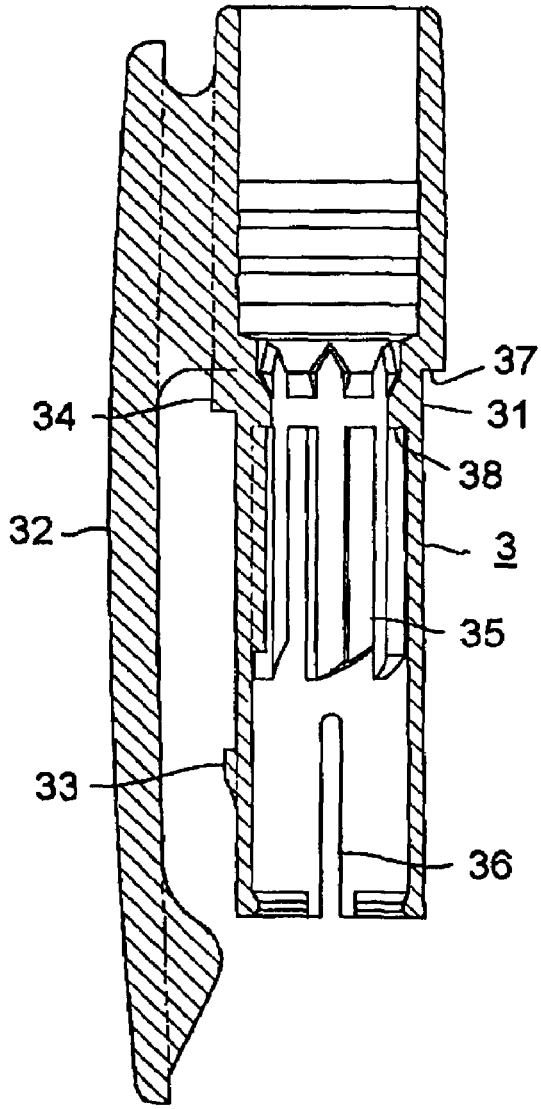
FIG. 4 is an enlarged longitudinal sectional view of a back cap.
Figure 5:
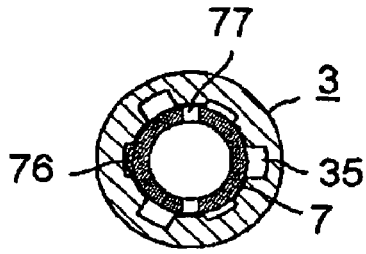
FIG. 5 is a cross-sectional view of the back cap and a plunger engaged with the back cap.
Figure 6:
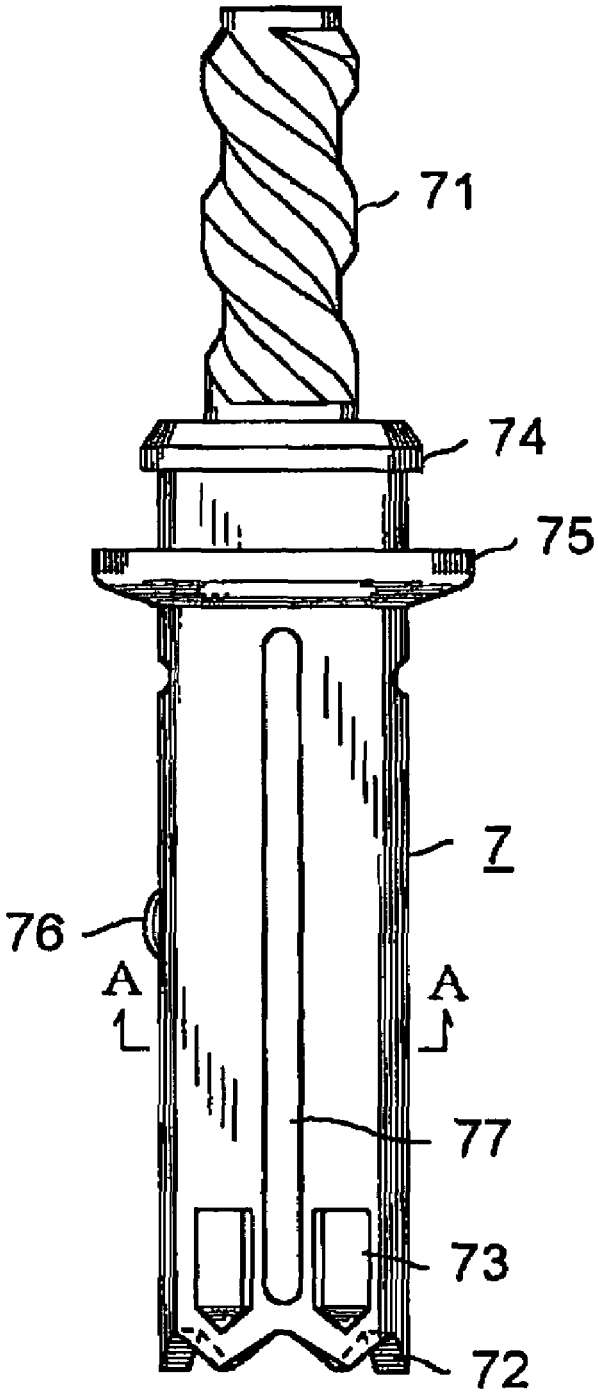
FIG. 6 is an enlarged front elevation of the plunger.
Figure 7:
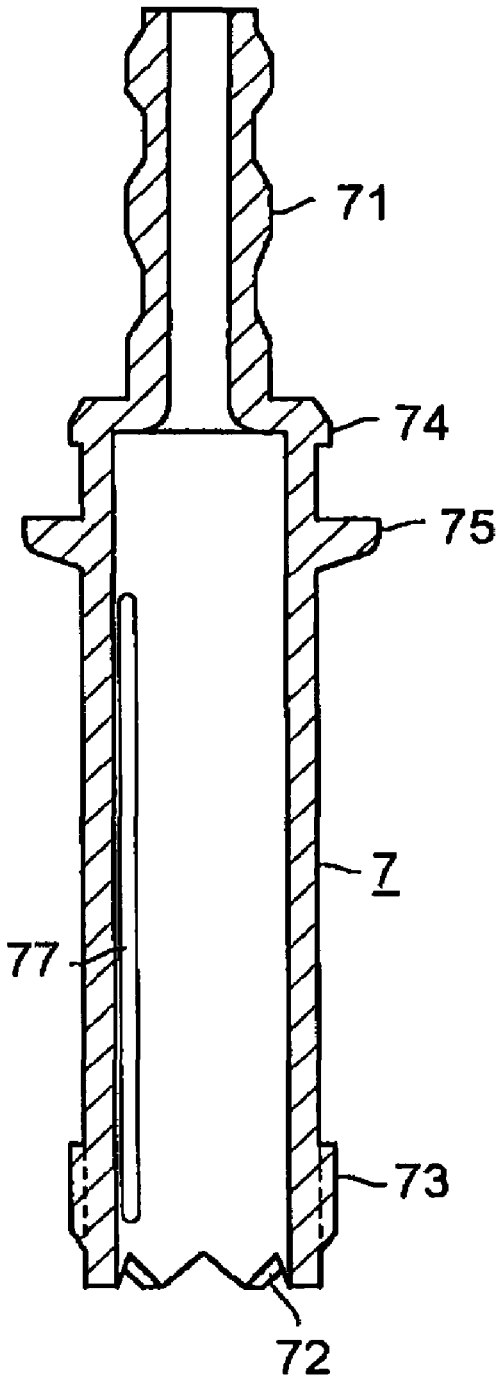
FIG. 7 is a longitudinal sectional view of the plunger.
Figure 8:
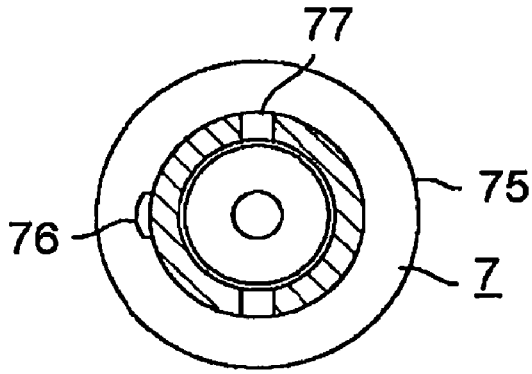
FIG. 8 is a cross-sectional view taken on the line A—A in FIG. 6.
Figure 9:
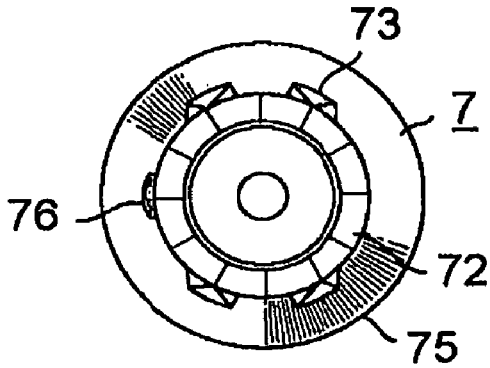
FIG. 9 is a bottom view of the plunger.
Figure 10:
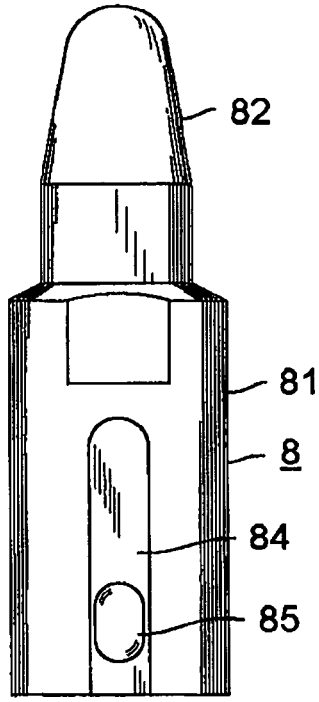
FIG. 10 is a front elevation of a stylus.
Figure 11:
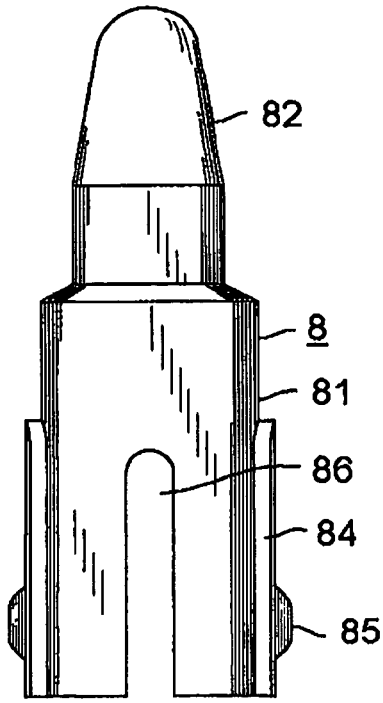
FIG. 11 is a side elevation of the stylus.
Figure 12:
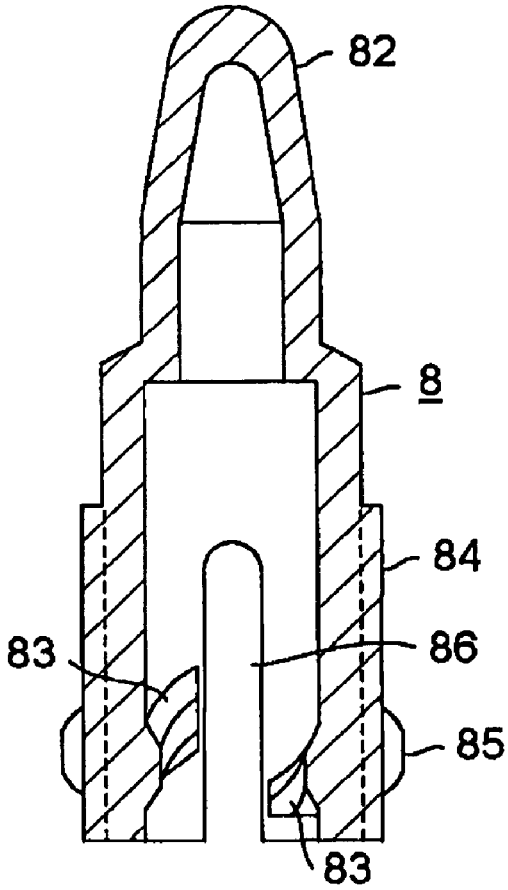
FIG. 12 is a longitudinal sectional view of the stylus.
Figure 13:
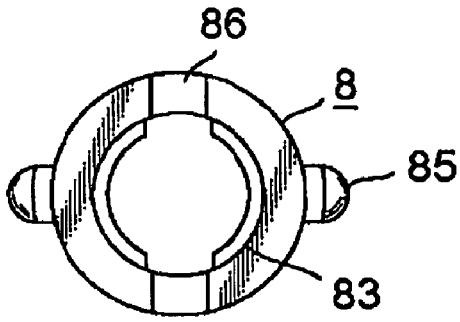
FIG. 13 is a bottom view of the stylus.
Figure 14:
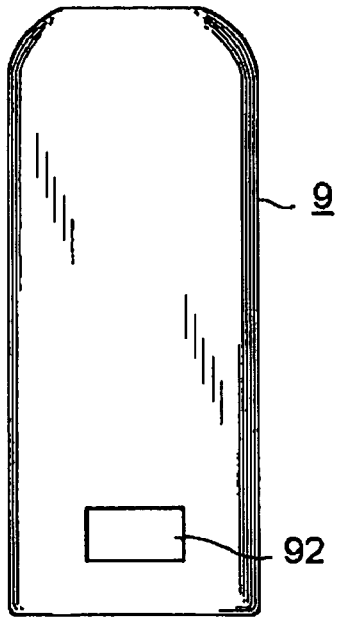
FIG. 14 is an enlarged front elevation of a push button.
Figure 15:
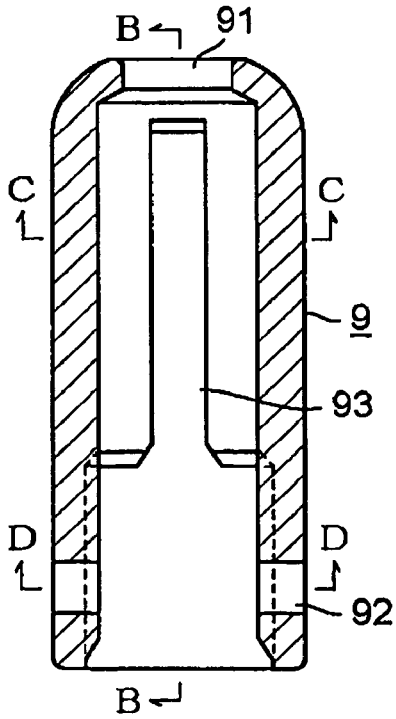
FIG. 15 is an enlarged longitudinal sectional view of the push button.
Figure 16:
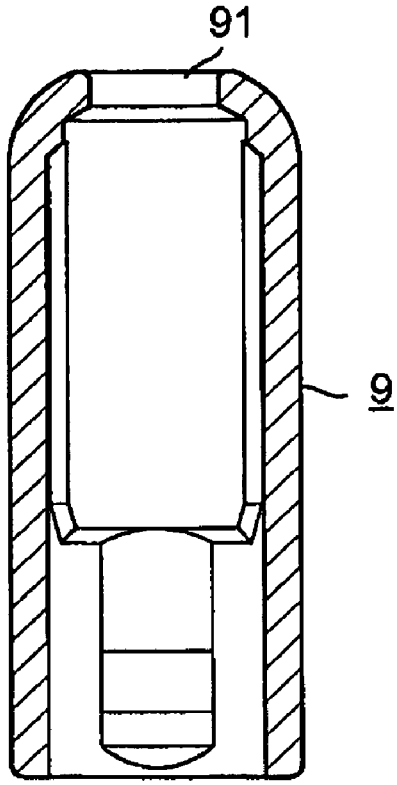
FIG. 16 is an enlarged longitudinal sectional view taken on the line B—B in FIG. 15.
Figure 17:
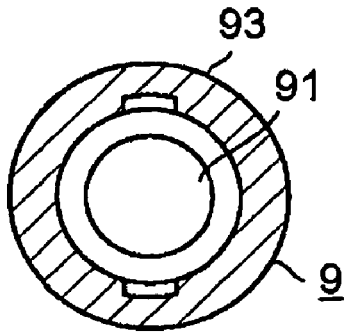
FIG. 17 is a longitudinal sectional view taken on the line C—C in FIG. 15.
Figure 18:
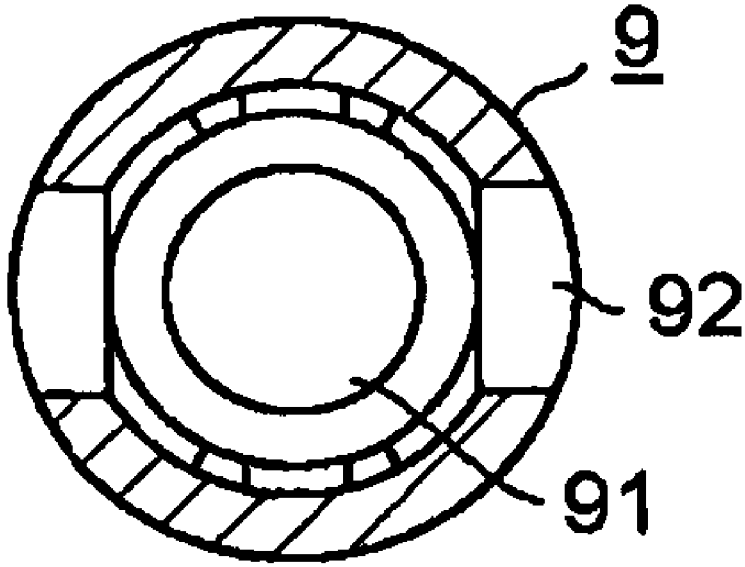
FIG. 18 is a cross-sectional view taken on the line D—D in FIG. 15.

FIG. 4 shows the back cap 3 fixedly put on the back end part of the barrel 1 and FIG. 5 shows the relation between the back cap 3 and a plunger 7. As shown in FIG. 4, the back cap 3 has a tubular body 31 and a clip 32 formed integrally with the tubular body 31. A retaining projection 33 is formed on the outer surface of the side wall of the tubular body 31 facing the clip 32. When the back cap 3 is put on the back part of the barrel 1, the retaining projection 33 is engaged in a retaining hole 11 formed in the barrel 1 to lock the back cap 3 in place on the barrel 1 so that the back cap 3 may not be easily moved. A projection 34 is formed on the outer surface of a part, near the back end of the clip 32, of the tubular body 31 of the back cap 3. The projection 34 engages in a recess 12 formed in the back end of the barrel 1 when the back cap 3 is put on the barrel 1. A cam groove 35 is formed in the inner surface of the tubular body 31. A rotating cam 6 has a cam part that engages in the cam groove 35. A slit 36 is formed in the tubular body 31. The slit 36 extends backward from the front end of the tubular body 31. A back part of the tubular body 31 is expanded to form a shoulder 37 between the expanded back part and a front part of the tubular body 31. Stopping ribs 38 are formed on the inner surface of the front part of the tubular body 31 at a position near the shoulder 37.

A sliding mechanism that slides longitudinally on the barrel 1 will be described. The ballpoint refill 4 inserted in the barrel 1 is axially movable in the barrel 1. A return spring 5 applies a resilient force constantly to the ballpoint refill 4 to push the ballpoint refill 4 backward. The ballpoint refill 4 has a tip 42 at its front end. A spring retaining part 41 is formed on the outer surface of a front part of the ballpoint refill 4. The return spring 5 is extended between the spring retaining part 41 and the front cap 2. The back end of the ballpoint refill 4 is received in a cam part 61 of the rotating cam 6. The cam part 61 of the rotating cam 6 has a cam follower engaged in the cam groove 35 of the back cap 3, and a toothed part engaged with a front toothed part 72 of the plunger 7. The rotating cam 6 is inserted in the plunger 7.

Referring to FIGS. 6 to 9 showing the plunger 7, the plunger 7 has the front toothed part 72 engaged with the upper end of the cam part 61 of the rotating cam 6, and an externally threaded part 71 provided with a double thread. Recessing undercut parts near a parting line facilitate molding. When the depth of back end parts of the external thread of the externally threaded part 71 is reduced slightly to increase frictional resistance against the movement of an internally threaded part 83 of the stylus 8 relative to the externally threaded part 71, a braking force acts on the push button 9 when the push button 9 is turned to a position near the limit of turning of the push button 9 to improve operating feeling.

The plunger 7 has flat ribs 73 having a pointed front end spaced a short distance apart from the toothed part 72. When the tip of the stylus 8 projects through an opening 91 formed in the back end of the push button 9 as shown in FIG. 3, the flat ribs 73 come into contact with and are stopped by the stopping ribs 38 of the back cap 3. The plunger 7 has a stopping flange 74 at the front end of the externally threaded part 71. An edge of the flange 74 on the side of the externally threaded part 71 is chambered. The plunger 7 has a large flange 75 spaced toward the toothed part 72 from the flange 74. An edge of the large flange 75 on the side of the toothed part is chambered in a taper surface. The plunger 7 has a stopping projection 76 formed near the toothed part 72. A pair of longitudinal slits 77 are formed in the plunger 7 to enable a molding core pin to be extracted.

Referring to FIGS. 10 to 13, the hollow stylus 8 having a tip part 82 is screwed on the externally threaded part 71 of the plunger 7. An internal double thread is formed in internally threaded part 83 of the inner surface of the stylus 8. The cylindrical push button 9 is put on the stylus 8. The push button 9 is able to turn on the stylus 8. The stylus 8 has a body part 81 of a large diameter, and the tip part 82 extending from the body part 81. The body part 81 has the internally threaded part 83 provided with the internal double thread, and diametrically opposite longitudinal guide ribs 84 on its outer surface. The guide ribs 84 are provided with protrusions 85, respectively. A pair of slits 86 are formed in the body part 81 so as to extend longitudinally from front end of the body part 81.

Referring to FIGS. 14 to 18, the push button 9 is a hollow, cylindrical member provided with the opening 91 at its back end. The stylus 8 is projected from and retracted into the push button 9 through the opening 91. Through holes 92 are formed diametrically opposite to each other in the side wall of the push button 9. A longitudinal stylus guide groove 93 is formed in the inner surface of the push button 9 so as to extend backward from a part near the open front end of the push button 9. A front end part of the stylus guide groove is flared toward the open end thereof. When necessary, teeth may be cut in the outer surface of the push button 9 by knurling to increase friction.

An assembling procedure for assembling the ballpoint pen, namely, a writing implement with a stylus, in the preferred embodiment will be described to facilitate understanding the construction of the ballpoint pen. The stylus 8 and the plunger 7 are combined in an assembly by engaging the internally threaded part 83 of the stylus 8 and the externally threaded part 71 of the plunger 7. The assembly is inserted in the push button 9 to form a push button assembly. The push button assembly is combined with the back cap 3 to form a back cap assembly. The return spring 5 is put in the barrel 1, the ballpoint refill 4 is inserted in the barrel 1 and the back cap assembly is attached to the barrel 1 to complete the ballpoint pen. The rotating cam 6 is inserted into plunger 7 prior to the attachment of the back cap assembly to the barrel 1.

The operation of the ballpoint pen will be described. When the ballpoint pen is used as a writing implement for writing, the push button 9 is pushed to advance the stylus 8, the plunger 7 and the rotating cam 6 against the resilience of the return spring 5. The rotating cam 6 engages with the ballpoint refill 4 as the same is advanced to advance the ballpoint refill 4. Since the cam part of the rotating cam 6 is engaged in the cam groove 35 of the back cap 3, the rotating cam 6 rotates as the same is advanced. The rotating cam 6 is stopped at the front end of the cam groove 35. Thus the ballpoint refill 4 is advanced and the tip 42 of the ballpoint refill 4 projects from the front cap 2 through the open front end of the front cap 2 to prepare the ballpoint pen for writing. The push button 9 is pushed again to retract the tip 42 of the ballpoint refill 4 into the barrel 1. When the push button 9 is pushed again, the rotating cam 6 is released from the cam groove 35 of the back cap 3, and the ballpoint refill 4 is pushed backward by the resilience of the return spring 5.

To use the stylus 8 with the ballpoint refill 4 retracted into the barrel 1, the ballpoint pen is held by the barrel 1 or the back cap 3 and the push button 9 is turned in one of opposite directions. Then, since the stopper rib of the stylus 8 is engaged in the stylus guide groove 93 of the push button 9, the stylus 8 turns as the push button 9 is turned. Since the toothed part of the plunger 7 is engaged with and restrained from turning by the back end of the cam part of the rotating cam 6, the stylus 8 screwed on the plunger 7 moves backward and projects through the opening 91 of the push button 9. Thus the stylus 8 is set for use.

The stylus 8 can be thus projected for use even in a state where the tip 42 of the ballpoint refill 4 is projected from the front cap 2 for writing. Even in a state where the push button 9 has been pushed, the stylus 8 can be projected by turning the pushbutton 9. In such a state, the push button 9 is restrained from free backward movement by the engagement of the stopping projection 76 of the plunger 7 with the stopping rib 38 of the back cap 3. In a state where the stylus 8 is projected for use, the ballpoint refill 4 can be advanced by pushing the stylus 8 or the push button 9 to project the tip 42 of the ballpoint refill 4 from the front cap 2. The projected stylus 8 can be retracted into the push button 9 by turning the push button 9 in the other direction.

The ballpoint pen of the present invention, namely, the writing implement, can be operated in the following operating modes.

Mode 1: Tip of the ballpoint refill is projected for writing with the stylus held inside the barrel.

Mode 2: Stylus is projected with the tip of the ballpoint refill retracted into the front cap.

Mode 3: Tip of the ballpoint refill is projected for writing with the stylus projected from the push button.

Mode 4: Stylus is held inside the barrel with the tip of the ballpoint refill retracted into the front cap.

Although the invention has been applied to a ballpoint pen, the present invention is applicable to other writing implements including mechanical pencils.

What is claimed is:

1. A writing implement having a barrel provided with a separate front cap or a front cap formed integrally with the barrel, and a writing member placed in the barrel, pushed constantly backward by a return spring and capable of axially sliding in the barrel, said writing implement comprising:

a rotating cam engaged with a back end part of the writing member;

a back cap provided on its inner surface with a fixed cam and fixedly attached to a back part of the barrel;

a hollow plunger placed between the back cap and the rotating cam and having an externally threaded back part provided with an external thread;

a stylus having an internally threaded bore provided with an internal thread in engagement with the external thread of the externally threaded part of the plunger, and provided on its outer surface with protrusions; and a hollow push button placed axially slidably in the back cap, and provided with guide means for guiding the protrusions of the stylus in its inner surface, and an opening through which the stylus is projected in its back end, wherein depth of back end parts of the external thread of the externally threaded part is reduced slightly to increase frictional resistance against turning of the push button.

* * * * *